US010688459B2

(12) United States Patent
Brothier et al.

(10) Patent No.: US 10,688,459 B2
(45) Date of Patent: Jun. 23, 2020

(54) DEVICE FOR MIXING POWDERS BY CRYOGENIC FLUID AND GENERATING VIBRATIONS

(71) Applicant: COMMISSARIAT À L'ÉNERGIE ATOMIQUE ET AUX ÉNERGIES ALTERNATIVES, Paris (FR)

(72) Inventors: Méryl Brothier, Aix en Provence (FR); Stéphane Vaudez, Avignon (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 245 days.

(21) Appl. No.: 15/772,327

(22) PCT Filed: Nov. 3, 2016

(86) PCT No.: PCT/EP2016/076508
§ 371 (c)(1),
(2) Date: Apr. 30, 2018

(87) PCT Pub. No.: WO2017/076945
PCT Pub. Date: May 11, 2017

(65) Prior Publication Data

US 2018/0318779 A1 Nov. 8, 2018

(30) Foreign Application Priority Data

Nov. 4, 2015 (FR) ..... 15 60571

(51) Int. Cl.
*B01F 3/00* (2006.01)
*B01F 3/12* (2006.01)
(Continued)

(52) U.S. Cl.
CPC ..... *B01F 11/0258* (2013.01); *B01F 3/186* (2013.01); *B01F 3/188* (2013.01);
(Continued)

(58) Field of Classification Search
CPC ..... B01F 11/0258; B01F 3/2246; B01F 13/0255; B01F 15/0022; B01F 3/186; B01F 3/188; B01F 3/00; B01F 3/12
(Continued)

(56) References Cited

U.S. PATENT DOCUMENTS 3,843,765 A * 10/1974 Anderson ..... G21C 1/22 75/399
4,571,086 A 2/1986 Wooten et al.
(Continued)

FOREIGN PATENT DOCUMENTS

CA 2882302 A1 2/2014
EP 0117708 A2 9/1984
(Continued)

OTHER PUBLICATIONS

International Search Report for PCT/EP2016/076508 dated Feb. 10, 2017.
(Continued)

*Primary Examiner* — Huy Tram Nguyen
(74) *Attorney, Agent, or Firm* — Pearne & Gordon LLP

(57) ABSTRACT

A device for mixing powders by a cryogenic fluid, characterised in that it comprises: a chamber for mixing the powders, comprising a cryogenic fluid, provided with means for forming a fluidised powder bed; a chamber for supplying powders in order to allow the powders to be introduced into the mixing chamber; a chamber for supplying cryogenic fluid in order to allow the cryogenic fluid to be introduced into the mixing chamber; a system for generating vibrations in the fluidised powder bed; and a system for controlling the system for generating vibrations.

17 Claims, 3 Drawing Sheets

(51) Int. Cl.

| | |
|---|---|
| ***B01F 11/02*** | (2006.01) |
| ***B01F 3/22*** | (2006.01) |
| ***B01F 13/02*** | (2006.01) |
| ***B01F 15/00*** | (2006.01) |
| ***B01F 3/18*** | (2006.01) |

(52) U.S. Cl.
CPC ..... *B01F 3/2246* (2013.01); *B01F 13/0255* (2013.01); *B01F 15/0022* (2013.01)

(58) Field of Classification Search
USPC ..... 366/108
See application file for complete search history.

(56) References Cited

U.S. PATENT DOCUMENTS 4,917,834 A 4/1990 Hadermann et al.
8,616,759 B2 * 12/2013 Cool ..... B01F 5/0618 366/118
2004/0031754 A1 2/2004 Pesiri et al.
2004/0057332 A1 * 3/2004 Taniguchi ..... B01F 1/0011 366/118
2005/0288542 A1 * 12/2005 Grandjean ..... C01G 56/004 588/313
2017/0345521 A1 11/2017 Vaudez et al.
2017/0358376 A1 12/2017 Benedetti et al.

FOREIGN PATENT DOCUMENTS

EP 1864710 A1 12/2007
WO 9910092 A1 3/1999
WO 2006111266 A1 10/2006

OTHER PUBLICATIONS

Preliminary French Search Report for FR 15 60571 dated Sep. 6, 2016.
D. Geldart, "Types of Gas Fluidization", Powder Technology, vol. 7, 1973, pp. 285-292.

* cited by examiner

DEVICE FOR MIXING POWDERS BY CRYOGENIC FLUID AND GENERATING VIBRATIONS

This is a National Stage application of PCT international application PCT/EP2016/076508, filed on Nov. 3, 2016 which claims the priority of French Patent Application No. 15 60571, filed Nov. 4, 2015, both of which are incorporated herein by reference in its entirety.

TECHNICAL FIELD

This invention relates to the field of preparing granular mediums, and more precisely to the mixing of powders, in particular of actinide powders, and to the deagglomeration/reagglomeration thereof in order to obtain a mixture of high homogeneity through a cryogenic fluid, also called a cryogenic median.

In a privileged manner, it applies to high density and/or cohesive powders, such as actinide powders. The invention as such preferably has application for the mixing of actinide powders allowing for the formation of nuclear fuel, in particular pellets of nuclear fuel.

The invention as such proposes a device for mixing powders by a cryogenic fluid, as well as an associated method for mixing powders.

PRIOR ART

Implementing different steps for preparing a granular medium, in particular from actinide powders in order to form pellets of nuclear fuel after forming by pressing, is essential as it substantially conditions the control of the microstructure of the final produce but also the presence or not of macroscopic aspect defects within a fuel pellet. In particular, the mixture of actinide powders in order to allow for the production of nuclear fuel constitutes a key step in the controlling of the quality of the fuel pellet obtained, which most often is subjected to compliance with strict requirements in terms of microstructure and impurities.

The industrial, conventional and historical method of powder metallurgy applied to the elaboration of nuclear fuel is based on steps of mixing, grinding and/or granulation, all carried out dry. Indeed, implementing liquid in the nuclear industry induces the generation of effluents that can be difficult to treat. Also, for the preparing of a granular medium for the purpose of elaborating nuclear fuel, procedures are not conventionally used other than those that use the dry method.

In order to carry out the mixing of powders, various devices are known in prior art, which can be broken down according to the families described hereinafter.

First of all, there is the principle of the dry phase mixer without internal media. This can in particular be a mixer of the Turbula® type from the company WAB which through movements that are more or less complex of the tank containing the powders to be mixed, allows for a more or less substantial homogenisation of the granular medium. Generally, the effectiveness of this type of mixture is limited. Indeed, according to the type of powders to be mixed, heterogeneous zones can subsist, for which the mixture does not take place or in the least incorrectly and inadmissibly. The kinematics of this type of mixture is generally not complex enough to induce a pushed mixture, i.e. a mixture that is satisfying in terms of homogeneity, without a pushed development itself or a mixing duration that is penalising at the industrial level. Moreover, the energy transmitted to the granular medium in this type of mixer does not make it possible to carry out deagglomeration that is sufficient to reach sufficient degrees of homogeneity in the case where the size of these agglomerates is excessive (in particular to be offset during the step of sintering).

The principle of the media mixture is also known. According to this principle and in order to favour the operation of mixing, one or several mobile facilities can be used within the tank containing the powder to be mixed. These mobile facilities can be blades, turbines, coulters, ribbons, endless screws, among others. In order to improve the mixing, the tank can itself be mobile. This type of mixer can be more effective than the preceding category but still remains insufficient and suffers from limitations. Indeed, the mixing induces a modification in the granular medium via agglomeration or a deagglomeration that is difficult to control, which induces an overrunning of powders and/or a degradation in the flowability of the granular medium. Moreover, the use of mobile facilities (media) for mixing results in pollutions (contaminations) when it concerns mixing abrasive powders such as those that have to be implemented to produce nuclear fuel. In addition, the mobile facilities implemented induce retentions which generate flow rates of doses that have a substantial impact in the case of elaborating nuclear fuel.

There is also the principle of the mixer of the grinder type. Indeed, according to the usage mode and the type of technology of certain grinders, it is possible to produce mixtures of powders via co-grinding. This type of operation makes it possible to obtain a satisfactory mixture, from a homogeneity standpoint, but requires a relatively long grinding time, typically several hours, and also induces grinding phenomena that reduce the size of the particles of powders. This causes the generation of fine particles and a modification in the specific surface which also affects the possibility of using the powders later after the mixing thereof (modification in flowability, reactivity (possible oxidation), sinterability of the powders, etc.). In the framework of manufacturing nuclear fuel, the operation of co-grinding, by generating fine particles causes a non-negligible radiological impact, due to the retention and the propensity of the fine particles to disperse. Moreover, clogging phenomena can be induced.

After using these various types of mixers, it is often necessary to carry out an agglomeration or granulation. In addition, these devices are generally discontinuous, which can be an issue in industrial methods.

Generally, the aforementioned mixers are not fully satisfactory for mixing certain powders, such as actinide powders, and it is necessary to follow this with a step of granulation in order to obtain a flowable granular medium.

Other mixtures are also known, implementing a multiphase medium, namely fluid-solid phases. These mixers can be classified into two main categories described hereinafter.

First of all, there are mixers of the liquid/solid type. These mixes do not work for the implementing of powders soluble with the liquid phase used in the mixer or if the powders are modified by the contact with the fluid. Moreover, for powders that have a high density compared to the liquid introduced into the mixer, the mixture is most often not effective or requires substantial agitation speeds. Indeed, the pulling-off speed of a particle from the bottom of the agitator is directly linked to the difference in density between the particles constituting the powders and that of the liquid allowing for the placing in suspension. In this case, viscous liquids can be used but this induces an increased energy demand, and this proportionately to the increase in viscosity before reaching a turbulent regime to favour the mixing. Moreover, in this case of the mixer of the liquid/solid type, there is also the question of the separation of the liquid phase and of the solid phase after mixing. In the case of the mixture of actinide powders, this type of mixture would induce contaminated effluents that are very complicated to retreat, which is prohibitive. Furthermore, in practice, complete and homogeneous placing in suspension cannot be achieved when powders of a low granulometry are to be mixed. More precisely, in order to achieve optimum homogenisation, the so-called Archimedes dimensionless number must be greater than 10 (i.e. the forces of viscosities are less than the forces of gravity and inertia). Knowing that the particles that constitute powders to be mixed have relatively low diameters, typically less than 10 μm, it cannot be considered to produce homogenous and complete suspensions with this type of device without using additional means of mixing. In that respect, technologies, such as that described in patent application CA 2 882 302 A1, have been proposed but nevertheless remain inoperable for an application for mixing actinide powders, the means of vibration used do not allow for sufficient homogenisation with regards to the homogenisation objectives to be achieved and the particularities of actinide powders. In addition, for reasons of controlling criticality, the volume of the mixer has to be limited, in order to prevent any risk of double loading which could induce an exceeding of the permissible critical mass. Indeed, in a conventional liquid/solid mixer, the density of particles per volume of tank cannot be substantial, unless either exceeding an excessive agitation power, or undergoing a mixture kinetics that is too slow.

Finally note that mixers of powders in liquid phase, in particular of the type of those described in patent applications CA 2 882 302 A1, WO 2006/0111266 A1 and WO 1999/010092 A1, are not suited for the problem of a mixture of powders of the actinide powder type, because they would require excessively high agitation speeds to hope to pull off the powders from the bottom of the agitation tank and achieve levels of homogeneity that are in accordance with those sought in the nuclear industry. In addition, once again, they would induce contaminated effluents, difficult to manage industrially but also risks of criticality, even of radiolysis of the liquid phase used due to the fact of the nature of the powders to be implemented (beyond the fact that the latter can interact chemically with the liquid used).

Then, there are also mixers of the gas/solid type. This type of mixer can be operable and does not induce any risk of criticality. However, this type of mixer is hardly operable for powders that do not have sufficient fluidisation properties, conventionally C-type powders according to the classification of D. Geldart such as described in the publication Powder Technology, Vol. 7, 1973. However, this characteristic of poor fluidisation is encountered for cohesive actinide powders such as those implemented for manufacturing nuclear fuel. Moreover, beyond the difficulty in terms of fluidisation, with regards to the densities of the powders to be fluidised for the mixture, the superficial speed of the gas should be substantial and at least equal to the minimum speed of fluidisation. Also, this type of mixer appears hardly suitable for the mixing of cohesive powders and a fortiori with high density.

DISCLOSURE OF THE INVENTION

There is therefore a need to propose a new type of device for mixing powders for the preparation of granular mediums, and in particular for the mixing of actinide powders.

In particular, there is a need to be able at the same time to:

- deagglomerate the powders to be mixed without necessarily modifying the specific surface thereof and generate fine particles,
- mix the powders with a level of homogeneity that is sufficient to obtain a mixture of powders that meets the specifications, in particular in terms of homogeneity (i.e. making it possible in particular to obtain a representative elementary volume (REV) within the granular medium of about a few cubic micrometers to about 10 $\mu m^3$),
- not induce any pollution of the powders to be mixed, or modification in the surface chemistry, or generate liquid effluents that are difficult to treat,
- not induce any risk of specific criticality,
- not induce any risk of specific radiolysis,
- not induce any heating of the powders to be mixed,
- rely on a mixer with a limited diameter for controlling the risk of criticality even in the case of a loading error of the mixer,
- carry out the operation of mixing by limiting as much as possible the energy expended and this in a relatively short time with respect to the other mixers, i.e. about a few minutes compared to a few hours (for other mixing systems such as ball mills), for the same quantity of material to be mixed,
- have a continuous or practically continuous method of mixing.

The invention has for purpose to overcome at least partially the needs mentioned hereinabove and the disadvantages pertaining to embodiments of prior art.

The invention has for object, according to one of its aspects, a device for mixing powders, in particular of actinide powders, by a cryogenic fluid, characterised in that it comprises:

- a chamber for mixing the powders, comprising a cryogenic fluid, provided with means for forming a fluidised powder bed,
- a chamber for supplying powders in order to allow the powders to be introduced into the mixing chamber,
- a chamber for supplying cryogenic fluid in order to allow the cryogenic fluid to be introduced into the mixing chamber,
- a system for generating vibrations, in particular by ultrasound waves, in the fluidised powder bed,
- a system for controlling the system for generating vibrations.

Advantageously, within the mixing chamber, the powders are subjected to a fluidisation through the cryogenic fluid in order to obtain the fluidised powder bed.

Furthermore, this fluidised powder bed is subjected to the vibrations of the system for generating vibrations in order to preferably obtain a substantial disorder on the suspension of powders and of cryogenic fluid, with these vibrations being controlled through the controlling system in order to optimise the mixture.

Note that, usually, a cryogenic fluid here designates a liquefied gas retained in liquid state at low temperature. This liquefied gas is chemically inert in the conditions for implementing the invention, for the powders to be mixed and deagglomerated.

The device for mixing powders according to the invention can furthermore comprise one or several of the following characteristics taken individually or according to any technically possible combinations.

The cryogenic fluid can comprise a slightly hydrogenated liquid, which is a liquid comprising at most one hydrogen atom per molecule of liquid, having a boiling temperature less than that of water.

The device can furthermore comprise an analysis system, in particular a system for measuring the concentration in solids (i.e. powders) of the suspension of powders and of cryogenic fluid in the mixing chamber, of which the operation is in particular controlled by the controlling system.

The mixing chamber can be configured in such a way that the introduction of cryogenic fluid into the latter allows for a fluidisation of the powders to be mixed by percolation of the cryogenic fluid through the powder bed fluidised as such.

Moreover, the mixing chamber can comprise a distribution system, in particular a grille or a sintered part, of the cryogenic fluid through the fluidised bed of powders in order to allow for a homogeneous distribution of the cryogenic fluid in the fluidised bed.

The system for generating vibrations can be at least partially located in the fluidised powder bed. In particular, the system for generating vibrations can comprise sonotrodes introduced into the fluidised powder bed.

The sonotrodes can be controlled independently by the controlling system in order to induce a periodic phase shift of the phases between the sonotrodes in order to introduce unsteady interferences that improve the mixture within the fluidised bed of powders.

The sonotrodes can further be configured to generate pseudo-chaotic oscillations, potentially for example through a generator of oscillations of the Van der Pol type.

The mixing device can furthermore comprise means for agitation in the mixing chamber in order to favour the mixing of powders placed in suspension in the cryogenic fluid, comprising in particular means for grinding, for example of the ball, roller type, among others.

In addition, the device for mixing can also comprise a system of electrostatic charge of the powders intended to be introduced into the mixing chamber.

A portion of the powders can in particular be placed in contact with a portion of the electrostatic charge system in order to be positively electrostatically charged and the other portion of the powders can be placed in contact with the other portion of the electrostatic charge system in order to be negatively electrostatically charged, in order to allow for a differentiated local agglomeration. In case of mixture of more than two types of powders, certain powders can be either positively charged, or negatively charged, or without charge.

The cryogenic fluid can moreover be of any type, being in particular liquefied nitrogen or argon. Note that the use of nitrogen is pertinent due to its low price but also due to the fact that the glove boxes and the methods implemented for the elaboration of the nuclear fuel with a plutonium base are inerted with nitrogen and the liquid nitrogen is itself used in certain operations on the fuel (BET measurement, etc.). The usage of this type of cryogenic fluid therefore does not induce any particular additional risk in the method of elaboration.

Furthermore, the invention further has for object, according to another of its aspects, a method for mixing powders, in particular of actinide powders, by a cryogenic fluid, characterised in that it is implemented by means of a device such as defined hereinabove, and in that it comprises the following steps:

a) introduction of powders intended to be mixed into the mixing chamber through the chamber for supplying powders, b) introduction of cryogenic fluid intended to allow for the fluidisation of the fluidised bed of powders into the mixing chamber through the chamber for supplying cryogenic fluid, c) setting into vibration of the suspension of powders and of cryogenic fluid in the mixing chamber through the system for generating vibrations, d) obtaining of a mixture formed from powders after evaporation of the cryogenic fluid.

During the first step a), the powders can advantageously be electrostatically charged differently, in particular oppositely in the presence of at least two types of powders, in order to favour differentiated local agglomeration.

The method can also comprise the step of controlling the system for generating vibrations through the controlling system, according in particular to the concentration in particles of the suspension.

The device and the method for mixing powders according to the invention can comprise any of the characteristics mentioned in the description, taken individually or according to any technically possible combinations with other characteristics.

BRIEF DESCRIPTION OF THE DRAWINGS

The invention can be better understood when reading the following detailed description, of non-limiting embodiments of the latter, as well as examining the figures, diagrammatical and partial, of the annexed drawing, wherein.

In all of these figures, identical references can designate identical or similar elements.

In addition, the various portions shown in the figures are not necessarily shown according to a uniform scale, in order to render the figures more legible.

DETAILED DESCRIPTION OF PARTICULAR EMBODIMENTS

Note that in the embodiments described hereinafter, the powders P considered are actinide powders that allow for the manufacture of pellets of nuclear fuel. In addition, the cryogenic fluid considered here is liquefied nitrogen. However, the invention is not limited to these choices.

Figure 1:
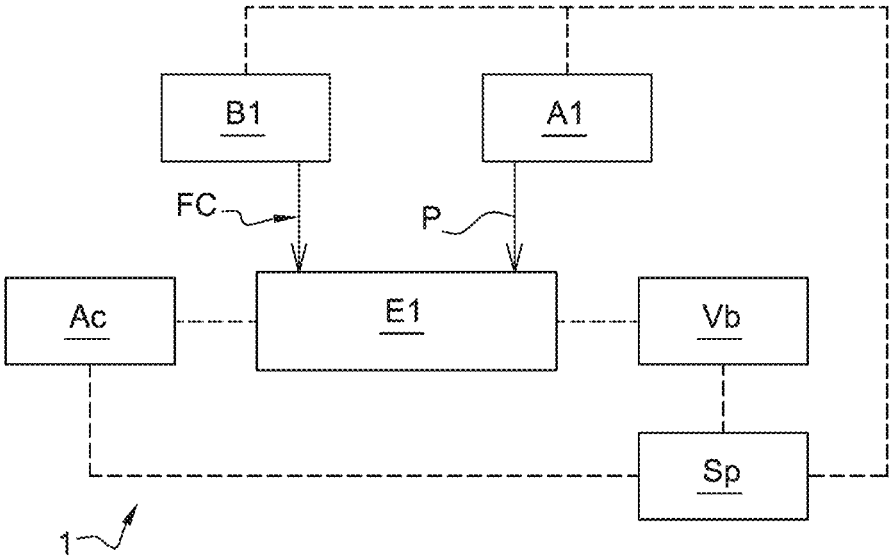
FIG. 1 shows a diagram illustrating the general principle of a device for mixing powders by a cryogenic fluid in accordance with the invention, FIG. 2 partially shows an example of the device in accordance with the invention.

In reference to FIG. 1, a diagram is shown illustrating the general principle of a device 1 for mixing powders P by a cryogenic fluid according to the invention.

Figure 2:
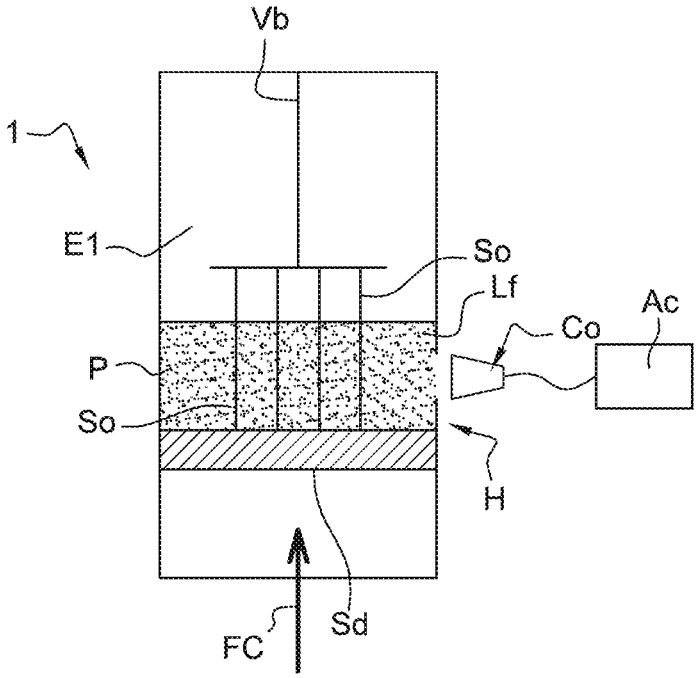

According to this principle, the device 1 comprises a mixing chamber E1, preferably thermally insulated, of powders P provided with means for forming a fluidised powder bed Lf, which can be seen in FIG. 2 described in what follows.

In addition, the device 1 comprises a chamber A1 for supplying powders P in order to allow for the introduction of powders P into the mixing chamber E1, and a chamber B1 for supplying cryogenic fluid FC in order to allow for the introduction of the cryogenic fluid FC into the mixing chamber E1. In this way, it is possible to obtain a suspension of powders P and of the cryogenic fluid FC in the mixing chamber E1 forming a fluidised bed Lf.

The chamber B1 for supplying cryogenic fluid FC can correspond to a chamber for distributing or a chamber for recirculating cryogenic fluid FC. This chamber B1 for supplying can allow for the distribution and/or the recycling of cryogenic fluid FC. It can in particular for a portion rely on a pressurising of a reservoir for the supply of liquefied gas.

Moreover, advantageously, the device 1 also comprises a system for generating vibrations Vb in the fluidised powder bed Lf, a system Sp for controlling this system for generating vibrations Vb, and a system for analysing the concentration Ac of the suspension of powders P and of cryogenic fluid FC in the mixing chamber E1, of which the operation is controlled by the controlling system Sp.

The controlling system Sp can in particular allow for the controlling of the operation of the device 1 and the processing of data, in particular in terms of conditions for supplying with powders P, with cryogenic fluid FC and/or in terms of amplitude of the vibrations.

Advantageously, as it will appear more clearly in reference to FIG. 2, the mixing chamber E1 is configured in such a way that the introduction of cryogenic fluid FC into the latter will allow for a placing in fluidisation of the powders P to be mixed by percolation of the cryogenic fluid FC through the powder bed fluidised as such Lf.

In reference to FIG. 2 indeed, an example of the mixing device is partially and diagrammatically shown 1 in accordance with the invention.

This mixing device 1 comprises a mixing chamber E1 forming a reservoir with a main vertical axis having advantageously a symmetry of revolution, in particular in the shape of a cylinder, and being advantageously thermally insulated in order to minimise heat losses as its vocation is to receive a circulating liquefied gas phase.

Advantageously, the cryogenic fluid FC (liquefied gas) is introduced into the bottom portion of the mixing chamber E1, at the inlet of the fluidised bed Lf of powders P, through a distribution system Sd, in particular in the form of a grille or sintered part, making it possible to distribute the cryogenic fluid FC homogeneously over the section of the passage of the fluidised bed Lf.

Moreover, the mixing chamber E1 can be provided with a diverging zone in order to disengage the smallest particles of powders P and allow them to remain in the zone of the fluidised bed Lf.

Furthermore, a system for analysing the concentration Ac of the suspension of powders P and of cryogenic fluid FC in the mixing chamber E1 is also provided, with this system Ac comprising in particular an optical sensor Co making it possible to observe the fluidised bed Lf of powders P through a viewing porthole H. The system Ac is as such interfaced through the fluidised bed Lf.

The system for analysing the concentration Ac, provided with the optical sensor Co, can make it possible to analyse the concentration of the powders P, and even also analyse the granulometry of the granular medium formed in the mixing chamber E1.

The system for analysing the concentration Ac can comprise an optical fibre of the emitting type (source of light illuminating the fluidised bed Lf) and receiving (sensor) type. It can further comprise a camera. Note then that the concentration of the particles depends on the distance between the emitting fibre and the receiving fibre, on the granulometric distribution of the particles, in the refractive index of the granular medium, and on the wavelength of the incident beam in the dispersion medium.

Moreover, the device 1 comprises the system for generating vibrations Vb. This system advantageously comprises sonotrodes So.

As can be seen in FIG. 2, the system for generating vibrations Vb is introduced in line with the fluidised bed Lf as close as possible to the introduction of the cryogenic fluid FC. In particular, the sonotrodes So can plunge within the fluidised bed Lf.

Figure 3:
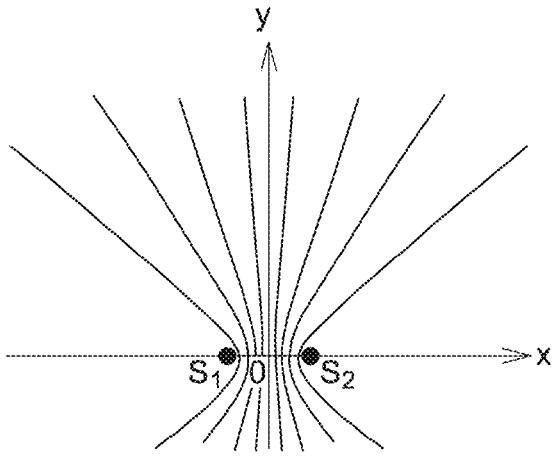
FIG. 3 shows a representation of lines of interferences induced by two vibrational sources that two vibratory sources that have the same pulse frequency.

The sonotrodes So can be controlled independently by the controlling system Sp (not shown in FIG. 2) in order to induce a periodic phase shift of the phases between the sources of vibrations in order to introduce unsteady interferences, in such a way as to improve the mixture within the fluidised bed Lf of powders P. In this respect, FIG. 3 shows a representation of the interference lines induced by two vibratory sources S1 and S2 having the same pulse frequency.

Figure 4A:
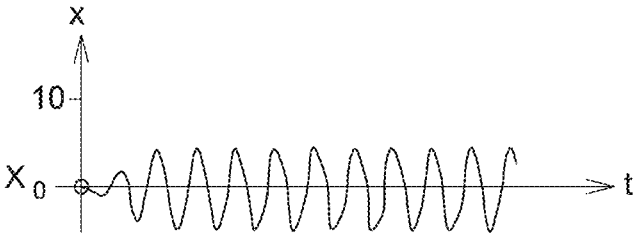
FIGS. 4A and 4B show the generation of stable oscillations induced by an oscillator of the Van der Pol type after convergence.
Figure 4B:
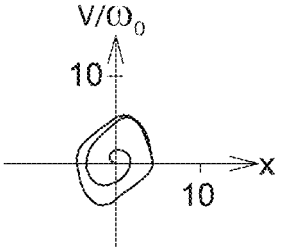
Figure 5A:
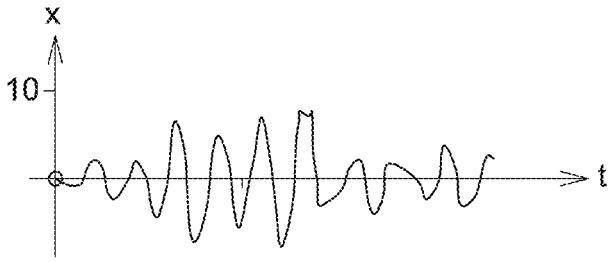
FIGS. 5A and 5B show the generation of quasi-chaotic oscillations of an oscillator of the Van der Pol type when its control parameters are adapted, and FIGS. 6, 7 and 8 respectively show photographs of a first type of powders before mixing, of a second type of powders before mixing, and of the mixture obtained from the first and second types of powders after mixing through a device and a method in accordance with the invention.
Figure 5B:
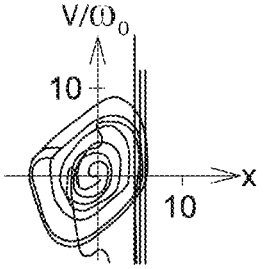

Moreover, advantageously, the controlling of the vibrations through the controlling system Sp can induce quasi-chaotic vibratory signals. This can be achieved by controlling the sonotrodes So as as many oscillators of the Van der Pol type having unsteady adjustment parameters. In this respect, FIGS. 4A-4B and 5A-5B show the forms of interference within the suspension of powders P induced by two sources that have the same pulse phase, with these phases being constant. More precisely, FIGS. 4A and 4B show the generation of stable oscillations after convergence (parameters of the oscillator chosen: a=2.16, b=2.28 and $w_0$=3 for an equation of motion of the type $x''+ax'\cdot(x^2/b^2-1)+w_0^2\cdot x=0$), while FIGS. 5A and 5B show the generation of quasi-chaotic oscillations of an oscillator of the Van der Pol type, of an equation of the type $x''+ax'\cdot(x^2/b^2-1)+w_0^2\cdot x=0$, by time variation of the pulse $w_0$.

Note that, by varying the phases of the sources of vibrations, the interferences can travel by a distance equivalent to the magnitude of the wavelength of the vibrations injected within the fluidised bed Lf. This thus allows for an addition degree of mixture.

The application of vibrations according to complex oscillations, in particular quasi chaotic, contributes to a practically ideal mixture effect.

Moreover, it is also to be noted that the chamber A1 for supplying powders P (not shown in FIG. 2) can allow for a supply via gravity, or even by a device of the endless screw type, or further even through a vibrating bed, for example.

In addition, advantageously, the powders P can be electrostatically charged with opposite charges in order to make it possible during the placing in suspension to obtain a differentiated reagglomeration.

The table 1 hereinafter moreover gives an example of the dimensioning of a device 1 in accordance with the invention.

TABLE 1

| Characteristics of the device 1 | Values |
|---|---|
| Useful diameter of the mixing chamber E1 | 15 cm |
| Useful height of the mixing chamber E1 | 40 cm |
| Circulation flow rate of the cryogenic fluid FC | 0.5 $m^3/h$ |
| Useful load of powders P | 2 kg |
| Mixing time | about 5 min |

The effectiveness of the mixture that can be achieved through this invention can be characterised by the homogeneity of the granular medium obtained after mixing. As such, FIGS. 6, 7 and 8 respectively show photographs of a first type of powders before mixing, of a second type of powders before mixing, and of the mixture obtained from the first and second types of powders after mixing through a device 1 and a method in accordance with the invention.

Figure 6:
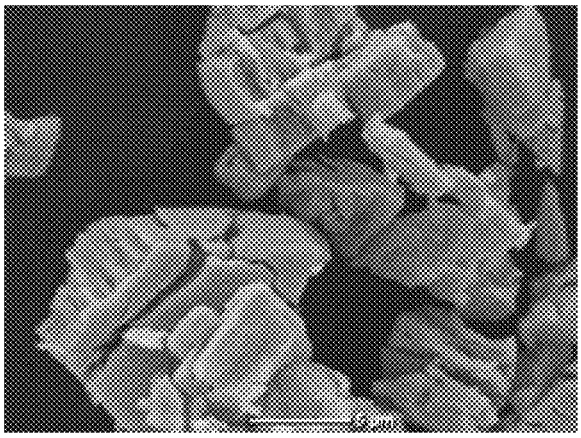
Figure 7:
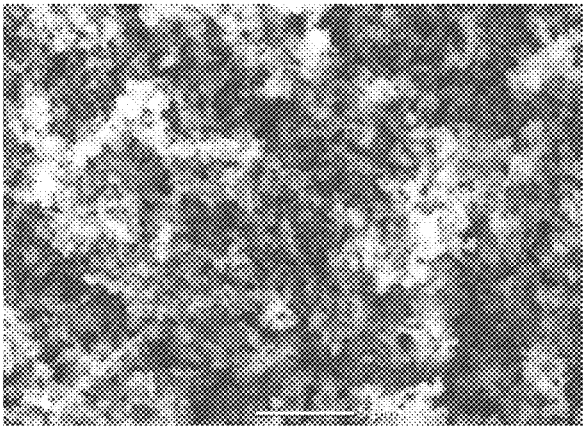
Figure 8:
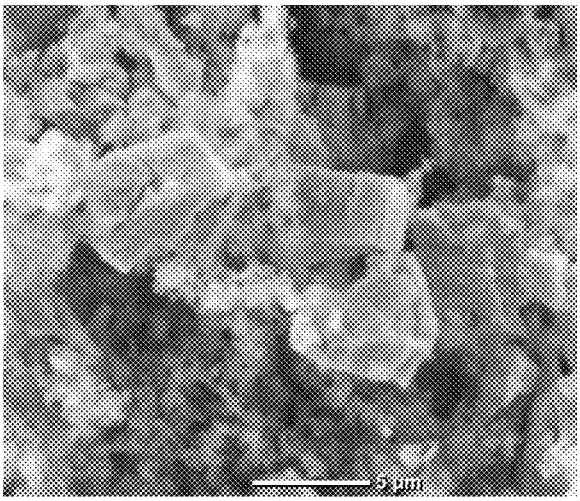

More precisely, FIG. 6 shows aggregates of cerium dioxide powders $CeO_2$, FIG. 7 shows aggregates of alumina powders $Al_2O_3$, and FIG. 8 shows the mixture of these powders obtained with a mixing time of about 30 seconds.

Good homogeneity of the granular medium after mixing is as such observed (of two powders implemented with equivalent masses). Indeed, in FIG. 8, it can be observed that for a scale of a few dozen microns, the aggregates of the two powders are present in a relatively equally distributed manner and the size of the aggregates has hardly varied (close to that of the initial powders to be mixed, here with a dimension close to 5 μm).

The invention as such makes use of various technical effects that make it possible in particular to achieve the desired level of homogenisation, such as those described hereinafter:

- the improved deagglomeration, at least partial, of the powders P when the latter are placed in suspension in the cryogenic liquid FC,
- the improvement of the wettability of the powders P by using the liquefied gas constituted by the cryogenic fluid FC, which is a liquid with a low surface tension, compared to water, with the latter able to be used advantageously without using any additive that is difficult to eliminate,
- the agitation close to the regime of a perfectly agitated reactor implemented by the movement of the means for agitation, able or not able to use the placing in vibration of the suspension as described in what follows, with these vibrations then being advantageously unsteady in order to limit the heterogeneous zones.

Of course, the invention is not limited to the embodiments that have just been described. Various modifications can be made thereto by those skilled in the art.

The invention claimed is:

1. Device for mixing powders by a cryogenic fluid, comprising:

- a chamber for mixing the powders, comprising a cryogenic fluid, provided with means for forming a fluidised powder bed,
- a chamber for supplying powders in order to allow the powders to be introduced into the mixing chamber,
- a chamber for supplying cryogenic fluid in order to allow the cryogenic fluid to be introduced into the mixing chamber,
- a system for generating vibrations in the fluidised powder bed,
- a system for controlling the system for generating vibrations.

2. Device according to claim 1, wherein the powders to be mixed are actinide powders.

3. Device according to claim 1, wherein the cryogenic fluid comprises a slightly hydrogenated liquid, which is a liquid comprising at most one hydrogen atom per molecule of liquid, having a boiling temperature less than that of water.

4. Device according to claim 1, wherein it further comprises a system for analysing the concentration of the suspension of powders and of the cryogenic fluid in the mixing chamber, of which the operation is in particular controlled by the controlling system.

5. Device as claimed in claim 1, wherein the mixing chamber is configured in such a way that the introduction of cryogenic fluid into the latter allows for a fluidisation of the powders to be mixed by percolation of the cryogenic fluid through the powder bed fluidised as such.

6. Device as claimed in claim 1, wherein the mixing chamber comprises a distribution system, in particular a grille or a sintered part, of the cryogenic fluid through the fluidised bed of powders in order to allow for a homogeneous distribution of the cryogenic fluid in the fluidised bed.

7. Device as claimed in claim 1, wherein the system for generating vibrations is at least partially located in the fluidised bed of powders.

8. Device according to claim 7, wherein the system for generating vibrations comprises sonotrodes introduced into the fluidised bed of powders.

9. Device according to claim 8, wherein the sonotrodes are controlled independently by the controlling system in order to induce a periodic phase shift of the phases between the sonotrodes in order to introduce unsteady interferences that improve the mixture within the fluidised bed powders.

10. Device according to claim 7, wherein the sonotrodes are configured to generate pseudo-chaotic oscillations of the Van der Pol type.

11. Device as claimed in claim 1, wherein it further comprises means for agitation in the mixing chamber so as to allow the mixing of the powders placed in suspension in the cryogenic fluid.

12. Device as claimed in claim 1, wherein it comprises a system of electrostatic charge of the powders intended to be introduced into the mixing chamber.

13. Device according to claim 12, wherein a portion of the powders is put into contact with a portion of the electrostatic charge system in order to be positively electrostatically charged and wherein the other portion of the powders is put into contact with the other portion of the electrostatic charge system in order to be negatively electrostatically charged, in order to allow for a differentiated local agglomeration.

14. Device as claimed in claim 1, wherein the cryogenic fluid is liquefied nitrogen.

15. Method for mixing powders by a cryogenic fluid, implemented by means of a device as claimed in claim 1, comprising the following steps:

a) introduction of powders intended to be mixed into the mixing chamber through the chamber for supplying powders, b) introduction of cryogenic fluid intended to allow for the fluidisation of the fluidised bed of powders into the mixing chamber through the chamber for supplying cryogenic fluid, c) setting into vibration of the suspension of powders and of cryogenic fluid in the mixing chamber through the system for generating vibrations, d) obtaining of a mixture formed from powders after evaporation of the cryogenic fluid.

16. Method according to claim 15, wherein during the first step a), the powders are electrostatically charged differently in order to favour differentiated local agglomeration.

17. Method according to claim 15, wherein it also comprises the step of controlling the system for generating vibrations through the controlling system.

* * * * *